United States Patent [19]

Jalil et al.

[11] 4,448,401

[45] May 15, 1984

[54] APPARATUS FOR COMBINED HOT ROLLING AND TREATING STEEL ROD

[75] Inventors: Asjed A. Jalil, Holden; Earl S. Winslow, Jr., Grafton; Charles H. Gage, Westboro, all of Mass.

[73] Assignee: Morgan Construction Company, Worcester, Mass.

[21] Appl. No.: 443,618

[22] Filed: Nov. 22, 1982

[51] Int. Cl.[3] ..... C71D 9/56

[52] U.S. Cl. ..... 266/78; 266/87; 266/90; 266/106; 266/111; 72/286; 432/59; 148/156

[58] Field of Search ..... 198/811, 955; 193/35 B, 193/35 R, 35 HD; 148/153, 155, 156; 266/106; 34/236, 240; 432/144, 138, 59, 8, 247; 72/286

[56] References Cited

U.S. PATENT DOCUMENTS

| | | | |
|---|---|---|---|
| 3,940,961 | 3/1976 | Gilvar | 72/40 |
| 3,940,967 | 3/1976 | Vitelli | 72/201 |
| 4,026,731 | 5/1977 | Perrine | 148/134 |
| 4,054,276 | 10/1977 | Wilson | 266/106 |
| 4,269,593 | 5/1981 | Faulkner et al. | 432/58 |
| 4,270,899 | 6/1981 | Faulkner et al. | 432/58 |
| 4,375,884 | 3/1983 | Grotepass | 266/115 |

*Primary Examiner*—M. J. Andrews
*Assistant Examiner*—Christopher W. Brody
*Attorney, Agent, or Firm*—Thompson, Birch, Gauthier & Samuels

[57] ABSTRACT

Apparatus is provided whereby maximum options for the treatment of steel rod in direct sequence with rolling are available within a single piece of equipment, all on a single treatment line, and all at convenient, labor free, push-button control. Maximum application of heat to the rod is provided for heat treating, slow-cooling or intermittent reheat cooling or treating, and alternatively maximum application of cooling air is available by means of individually controllable air ducts and guides associated with each roller conveyor for applying air at different pressures both across and/or along the conveyor. Special means for applying forced air to the rod through outlets in contact with the rod assure maximum penetration of cooling air into the dense parts of the lay. Special forms of rollers are provided for applying cooling air to the rod and to the rollers as well as for supporting rod during heat treatment.

7 Claims, 10 Drawing Figures

APPARATUS FOR COMBINED HOT ROLLING AND TREATING STEEL ROD

FIELD OF THE INVENTION

This invention relates to methods and apparatus for cooling and treating hot rolled steel rod directly after rolling for the purpose of controlling the physical properties of the product. More particularly it relates to methods and apparatus adapted for improved control and versatility of cooling and/or treating hot rolled steel rod of widely differing sizes and steel chemistries.

BACKGROUND OF THE INVENTION

In the hot-rolling and cooling of steel rod (i.e. 7/32" up to ½" 0.D.), up until around 1964, the universal practise was to roll the rod, and, after cooling it with water in the delivery pipes, to coil it into a bundle either with or without forced air cooling. That method had serious disadvantages in that the physical properties of the steel could not be controlled and scale (oxidation) losses were significant. In general, medium-to-high carbon content (i.e. 0.3% C. to 0.9% C.) steel rod processed by that method required heat treatment (called "patenting") prior to being drawn into wire. That process produced steel rod in the low carbon content range (i.e. 0.03% C. to 0.20% C.) which, in some instances, could be processed to finished product without heat treatment, but in many other instances, required annealing or similar treatment. In the low alloy and high alloy content grades, further heat treatment was invariably required.

The advent of the so-called Stelmor process in 1964 (U.S. Pat. Nos. 3,231,432, 3,320,101, and 3,390,871), caused a major change in industry because it permitted rod to be rolled, laid, cooled and collected in such a way that, in the medium-to-high carbon content grades, the rod could be further processed in many instances to finished product without requiring any heat treatment. This was accomplished by first water-cooling the rod in the delivery pipes to about 800° C., then laying it in spread-out ring form onto a moving conveyor, and cooling it through transformation under the influence of an air blast passing through both the conveyor and the rings. The Stelmor process went into wide-spread use and rapidly rendered the prior method virtually totally obsolete.

Although the Stelmor process made tremendous savings for high carbon content steel rod, it did little for low carbon other than scale saving. In fact, it tended to cool low carbon rod too rapidly thereby rendering its tensile strength too high (and hence its ductility too low) for many uses. As a result, the prior practices of annealing low carbon rod continued more or less without change even after the advent of the Stelmor process. However, since low carbon steel rod represents about 75% to 80% of the demand for steel rod, and annealing costs are very substantial, a search still continued for ways to adapt the Stelmor equipment for the slow cooling requirements of low carbon rod. In addition, along with the rise in demand for products employing alloy constituents as in steel belted radial automobile tires, special reinforcing, and welding rods, significant tonnages of low alloy steel rod began to be rolled. Such steels require extremely slow cooling, likewise not hitherto feasible with equipment of the Stelmor type equipped for rapid cooling.

One partial solution of the low carbon problem was to have one rod rolling facility equipped for rapid, Stelmor-type cooling, for use with high carbon rod, and additional installations equipped to roll low carbon rod and cool it slowly or even partially to anneal it as described in U.S. Pat. No. 3,711,338. As mill delivery speeds began to increase into the +20,000 fpm range, however, it became even more desireable to provide more versatility in a single installation so that the advantages of high speed rolling could be attained and at the same time provide optimum processing conditions for the entire range of steel rod products.

An early attempt at versatility was practised in Holland in the late 1960's. It employed pivotally mounted, removable, insulated covers over a typical Stelmor bar and chain type conveyor. Also when slow cooling was desired, transite panels were inserted between the bars on the conveyor. That installation was only partially successful. Cooling rates within a single coil from about 0.5° C./sec to 2° C./sec were achieved. The slow cooling was not sufficiently uniform, however, for most products and the process was not adopted commercially.

Another attempt at versatility is described in U.S. Pat. No. 3,711,338 in which a roller hearth furnace is positioned alongside a typical Stelmor installation with provision to move the Stelmor conveyor aside and the furnace into line with the rolling mill so that very rapid cooling sufficient partially to form martensite can be performed initially and then followed by an annealing (or martempering), type of treatment.

Still another design for versatility is described in U.S. Pat. No. 3,930,900 in which radiant heating elements carried by removable, pivotally mounted covers are used to retard the cooling rate. This equipment performed well on some products. Additional designs for versatility are disclosed in U.S. Pat. No. 4,242,153 which offers the options of batch austempering, martempering and annealing in parallel with Stelmor.

In addition, recent discoveries in both the slow cooling and rapid cooling modes have shown the desirability of adding additional processing options to both the slow and rapid cooling modes.

For example, in order to achieve uniformity in the slow cooling mode, a procedure called "IRC" (intermittent reheat cooling) is desireable. IRC is described in copending application Ser. No. 215,331 (12/11/80) (see also European patent application Ser. No. 81300094.0). It involves allowing the rod to cool for a measured period of time under insulated "hot-box" conditions, and then reversing the direction of heat flow by passing the rings through a zone in which high heat is applied to the rod rings, as in a furnace, from underneath and above. In this way, the exposed, rapidly cooled places are reheated more rapidly, the reverse of the manner in which they had been cooled more rapidly previously, and thereby the temperature differences are equalized. The intermittent high heat applications, of course, are gradually diminished to achieve a gradual uniform overall cooling. They can, however, be maintained if tempering or annealing is desired.

Recent discoveries in the rapid cooling mode show that rod having properties approaching those of lead patented rod can be made if the rod is laid onto a relatively cool conveyor at relatively high temperature (at which austenite grain growth is rapid) and forced-air is applied to all parts of the rod gradually at first, building up to a maximum intensity during transformation. This procedure is also described in copending application Ser. No. 215,331 (12/11/80).

A basic object of this invention therefore, is to provide, in one and the same piece of equipment, a maximum range of treatment options and an ability for changes from any option to any other with a minimum of inconvenience. More specifically, an object of the invention is to provide equipment adapted for slow cooling, which offers the options of IRC, annealing, austempering, martempering and the like with or without preliminary water cooling and also adapted for rapid cooling together with means for maintaining a relatively cool conveyor and providing a greater intensity and more effective air cooling flow than was available in prior equipments. A further object is to provide the foregoing together with push-button control for rapid change from any one option to any other.

BRIEF DESCRIPTION OF THE INVENTION

A preferred embodiment of the invention selected for purposes of illustration comprises a steel rod rolling mill preferrably adapted for high speed rolling (i.e. +20,000 fpm). Conventional water cooling is provided in the delivery pipes at the output end of the mill, followed by means for laying the rod in spread-out ring form onto a moving conveyor. The conveyor is a roller conveyor and is provided with pivotally mounted (and hence removable), insulated covers provided with heating elements which may be as described in U.S. Pat. No. 3,930,900. Between each roller along a major part of the length of the conveyor, are located electrical resistance heating elements (or other form of heating element, as desired), and a cooling air application means is provided in association with each roller along the conveyor. The water cooling means, the means for pivoting the covers into and out of operation, the heating elements, the cooling air application means, and the conveyor speed, are each individually remotely controllable such that all treatment options can be initiated by "push button" operation from a remote control station. Remotely recording temperature sensing elements are located throughout the equipment so that operations can be monitored.

It is a feature of the invention that the equipment can be controlled to cool the rod very rapidly in the delivery pipes so as to form a partially martensitic structure, simply by calling for maximum cooling water in the delivery pipes, and that the rod can thereafter be readily tempered as desired (as in U.S. Pat. No. 3,711,238) by lowering the covers and turning on and adjusting the temperature of as many of the heating elements as desired. Also if slow, uniform cooling is desired, the covers can be lowered, the conveyor speed can be reduced so as to build the rings into a dense lay, and IRC can be practiced by commanding the application of heat at specific points along the conveyor pursuant to temperature indications from the remotely recording thermometers.

Various forms of cooling air application come within the scope of the invention. In one embodiment air supply plenum chambers are provided beneath the rollers and heaters (as in U.S. Pat. No. 3,930,900) communicating with and supplying cooling air to slotted orifices directly under each roller. In this embodiment, the cooling air, which may be supplied at different pressures along the length of each roller, is projected directly against the underside of each roller which divides its flow path such that the cooling air stream conforms to the surface of the rollers and converges at the top of the rollers against the overlying rod rings. In this embodiment, due to the fact that the cooling air passes over the surface of the rollers first, and also the fact that the surfaces of the rollers are hot from contact with the rod, the cooling air is heated prior to its reaching the rod. This causes a preliminary expansion of the air (per the Law of Charles, at atmospheric pressure, air doubles its volume for every 273° C. of increase of temperature), prior to its reaching the rod, which expansion also causes an acceleration of the velocity of the air stream which adds to the impinging force of the cooling air against the rod.

In another embodiment, guides are provided around the rollers to channel the cooling air to the top of the roller and force it to impinge directly against the rod rings.

In still another embodiment, the rollers are perforated or slotted and the cooling air is blown into one end of the rollers and out of the top of the rollers through the perforations directly into the dense lay of the rings. The concentration of the air at the perforations at the top of the rollers is accomplished by a fixed baffel around the roller.

The embodiments which bring the forced-air orifices directly against the underside of the lay are advantageous because, only in this way, can the cooling air penetrate the dense parts of the lay. This is because of the expansion factor mentioned above. Thus, when the cooling air at 20° C. contacts the rod at 1000° C., the air must either expand to twelve times its volume or its pressure must increase. Some of both reactions actually take place. The air cannot escape freely through the tightly packed strands and, therefore, its pressure increases along with its temperature increase. If the air application orifice is not held directly against the lay, the back-pressure simply retards further progress of the cooling air through the lay, and slow cooling results at the dense cross-overs as has been observed in typical Stelmor installations for many years. This localized slow cooling has not been as harmful as originally thought, for reasons explained in copending application Ser. No. 215,335, but, in order to equal lead patenting quality, it is desireable to cool more rapidly during transformation than in conventional Stelmor equipment, and the application of the cooling air through an orifice in direct contact with the lay helps accomplish this objective. It also is important to provide a positive feed of air to specific orifices so as to maintain the flow of cooling air despite heat-created back pressure. This is done by providing separate air supplies to specific orifices or groups of orifices.

Another aspect of the embodiment employing shielded perforated or slotted rollers is that the rollers are exposed only very briefly to the concentrated radiant heat of the rod rings, and that they only contact the rings for a small fraction of a second. In this way heat build-up at the surface of the rollers and premature heating of the cooling air are minimized.

Another feature of the shielded perforated or slotted roller embodiments is that larger diameter rollers with less space between them can be used. This makes possible a better conveying action by the rollers, for the rings and greater heat dissipation from the surface of the rollers between exposures to the heat of the rings.

BRIEF DESCRIPTION OF THE DRAWINGS

The preferred embodiments of the invention, selected for purposes of illustration, are shown in the accompanying drawings in which.

DETAILED DESCRIPTION OF THE INVENTION

Figure 1:
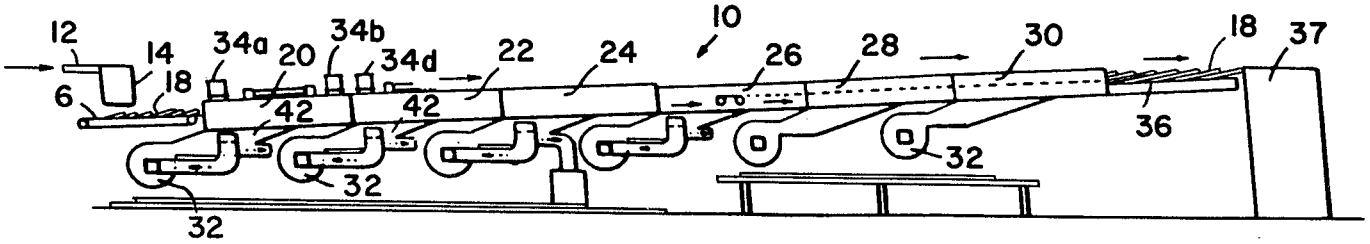
FIG. 1 is a view in side elevation of a controlled cooling line according to one embodiment of the invention.

An illustrative embodiment of the present invention, shown diagramatically in FIG. 1, comprises a conveyor indicated generally at 10 adapted to receive hot rolled steel rod issuing from a rolling mill (not shown) at high speed (+20,000 fpm) through a delivery pipe 12 which is equipped (optionally) to apply cooling water to the rod to cool it from rolling temperature (c 1000° C. to 1100° C.) down to a surface temperature as low as 550° C. The hot rolled rod is then passed through a laying head 14 which coils the rod into rings and lays then onto an endless wire mesh belt, run-in portion 16 of conveyor 10, which, due to its forward motion, spreads the falling rod out into rings 18. Although the laying head 14 herein shown coils the rings on a vertical axis, it will be understood that coiling on a tilted or horizontal axis is also intended and the horizontal axis is preferred for high delivery speeds.

Figure 1A:
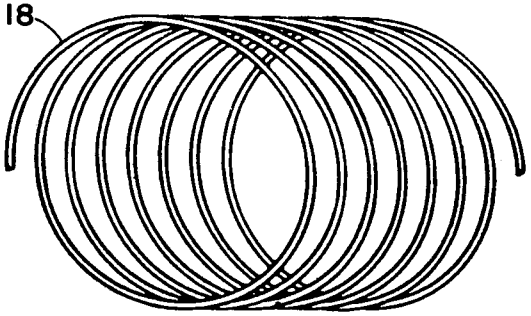
FIG. 1*a* is an enlarged view of spread-out rings substantially, as employed in the rapid cooling modes.

The depiction of the rings 18 in FIG. 1*a* is diagrammatic. In actual practice, however, the diameter of the rod will vary between 3/16" and ¾", the diameter of the rings will be about 3½', and the spacing of the rings will be between about 3" and 1/10" on centers depending upon the conveyor and delivery speeds, as may be required for various types of rod processing.

Figure 8:
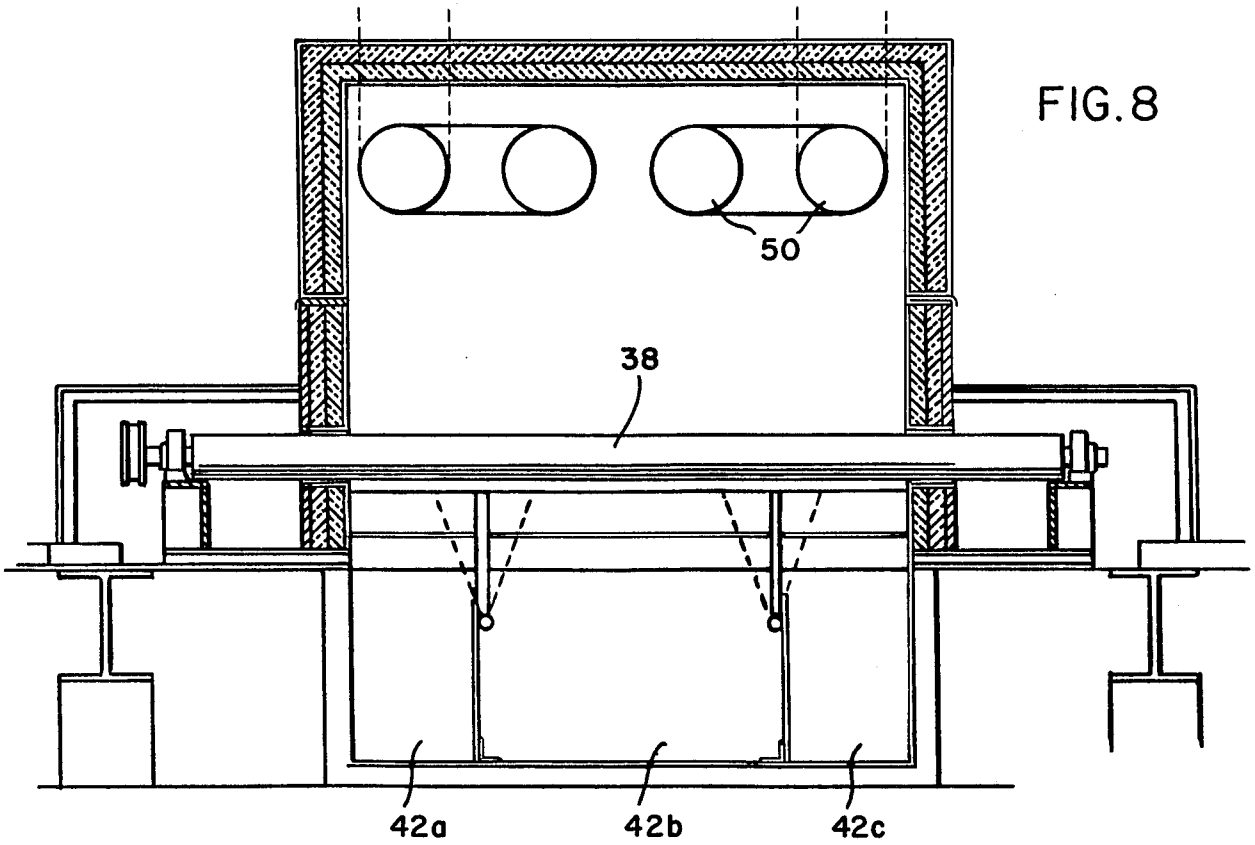
FIG. 8 is a view in cross section of another conveyor embodiment.
Figure 9:
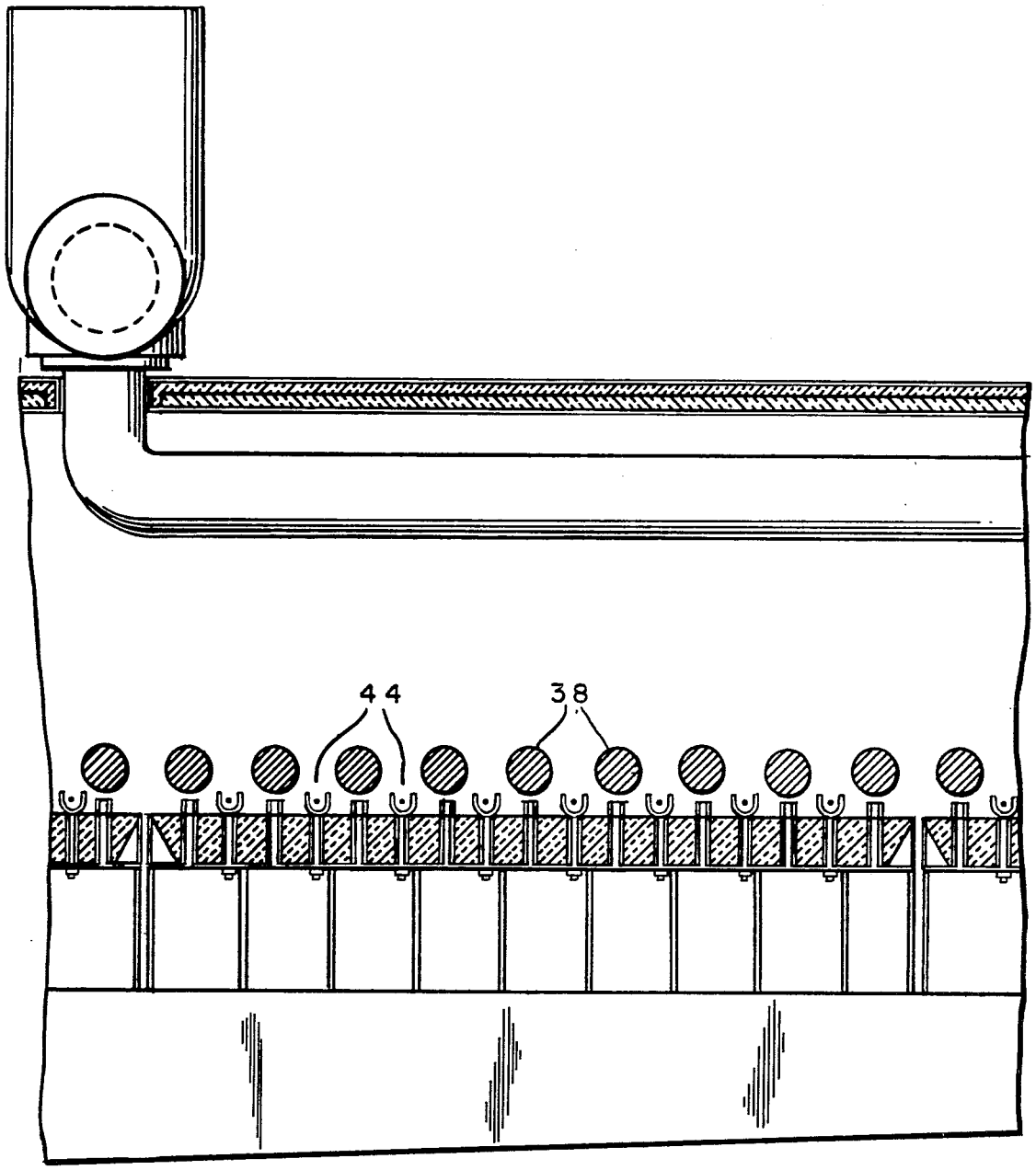
FIG. 9 is a view of an alternate form of arrangement for the rolls and heaters.

The conveyor 10 may be equipped with insulated and heated covers 20, 22, 24, 26, 28 and 30 as shown in FIG. 1. In one embodiment, blowers 32 are mounted below each conveyor section and are equipped to supply cooling air to the rod through plenum chambers 42. These chambers can be baffled across the conveyor, to provide a multiplicity of plenum 42*a*, 42*b* and 42*c* (see FIG. 8), each of which can be supplied by different blowers so that greater pressure can be supplied to the rod along the edges of the conveyor where the lay is more dense. Heat is applied to the covers 20, 22, etc., at 34*a*, 34*b*, etc. Conveyor 10 terminates with a wire mesh belt, run-out portion 36 which conveys the rings 18 to a collecting device 37.

Figure 2:
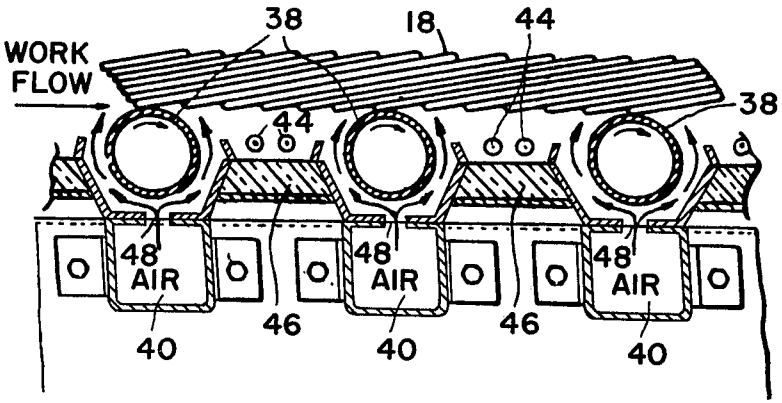
FIG. 2 is a view in cross section showing rolls of a roller conveyor each of which equipped with means for applying cooling air to the underneath side of hot rolled rod rings and also showing heating elements between adjacent rolls.

In the area of covers 20, 22 etc. the conveyor 10 comprises spaced, driven rollers 38, each of which, as shown in FIG. 2, is supplied with cooling air from fans 32 through small plenums 40 which communicate with fans 32 through larger plenums 42. Heaters 44, which may be electrical resistance elements as shown, or larger gas fired radiant heating elements, mounted over refractory material 46, are located between each pair of rollers 38.

Air, under pressure in plenums 40, passes upwardly through slots 48, around rollers 38 and then impinges against the undersurface of rings 18. Plenums 40 can be sectioned across the conveyor and slots 48 can be provided with vanes for adjusting the widths of different slots in different sections so as to vary the air application across the rings if desired.

Figure 7:
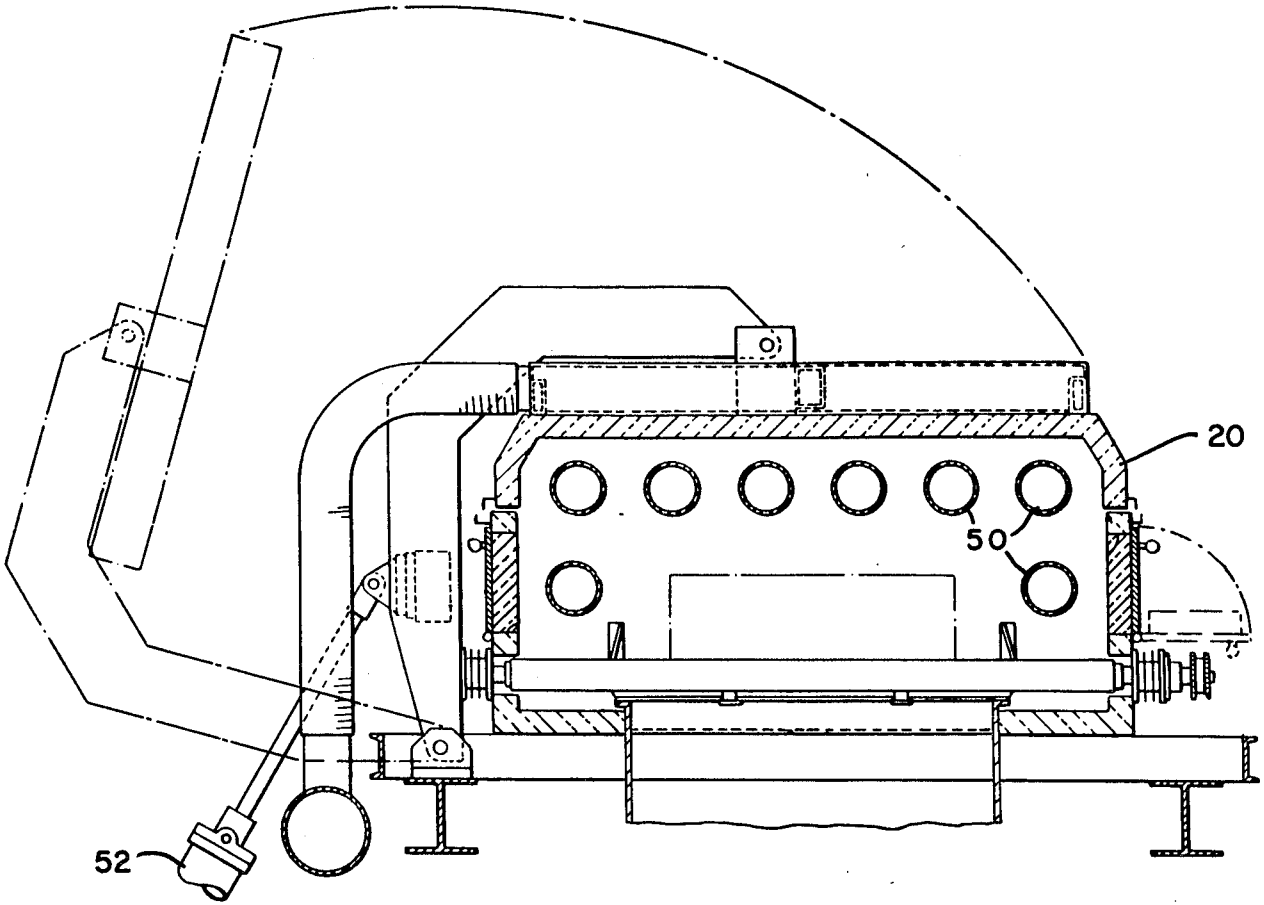
FIG. 7 is a view in cross-section of a conveyor equipped with pivotally mounted (removable) covers.

Additional heat for either retarded cooling or for heat treating may be supplied through gas-fired radiant heating tubes 50 carried by covers 20, 22, etc. as shown in FIG. 7. Covers 20, 22, etc. are also provided with remotely controllable pneumatic mechanism 52 for automatically pivoting them into or out of operative position.

Remotely recording heat and pressure indicating instruments are provided in each plenum 40, along the conveyor at closely spaced intervals along the conveyor 10 within the insulated (and heated) pivotally mounted covers 20, 22, etc., the air plenums 40 and adjacent to heating elements 44 and 50. Each element is individually remotely operable such that a wide variety of treatments can be performed under push-button control from a remote station. Among the treatments feasible are (a) extremely slow cooling (e.g., 0.2° C./sec) of a closely packed lay (i.e., 10 rings per inch) either with or without IRC, (b) laying the rings with a spacing of about 1" at a low temperature so as partially to form martensite (or bainite) followed by brief tempering (as in U.S. Pat. No. 3,711,338), (c) processing either low or medium-to-high carbon content rod as in conventional Stelmor equipment, (d) laying high carbon rod at elevated temperature, and applying cooling air uniformly to all parts of the rod, gradually at first and building up to maximum air application during transformation of the dense part of the lay, with the air being forced into the lay from jets positioned in contact with the undersurface of the lay, or (e) any variation of the foregoing.

Figures 3, 4:
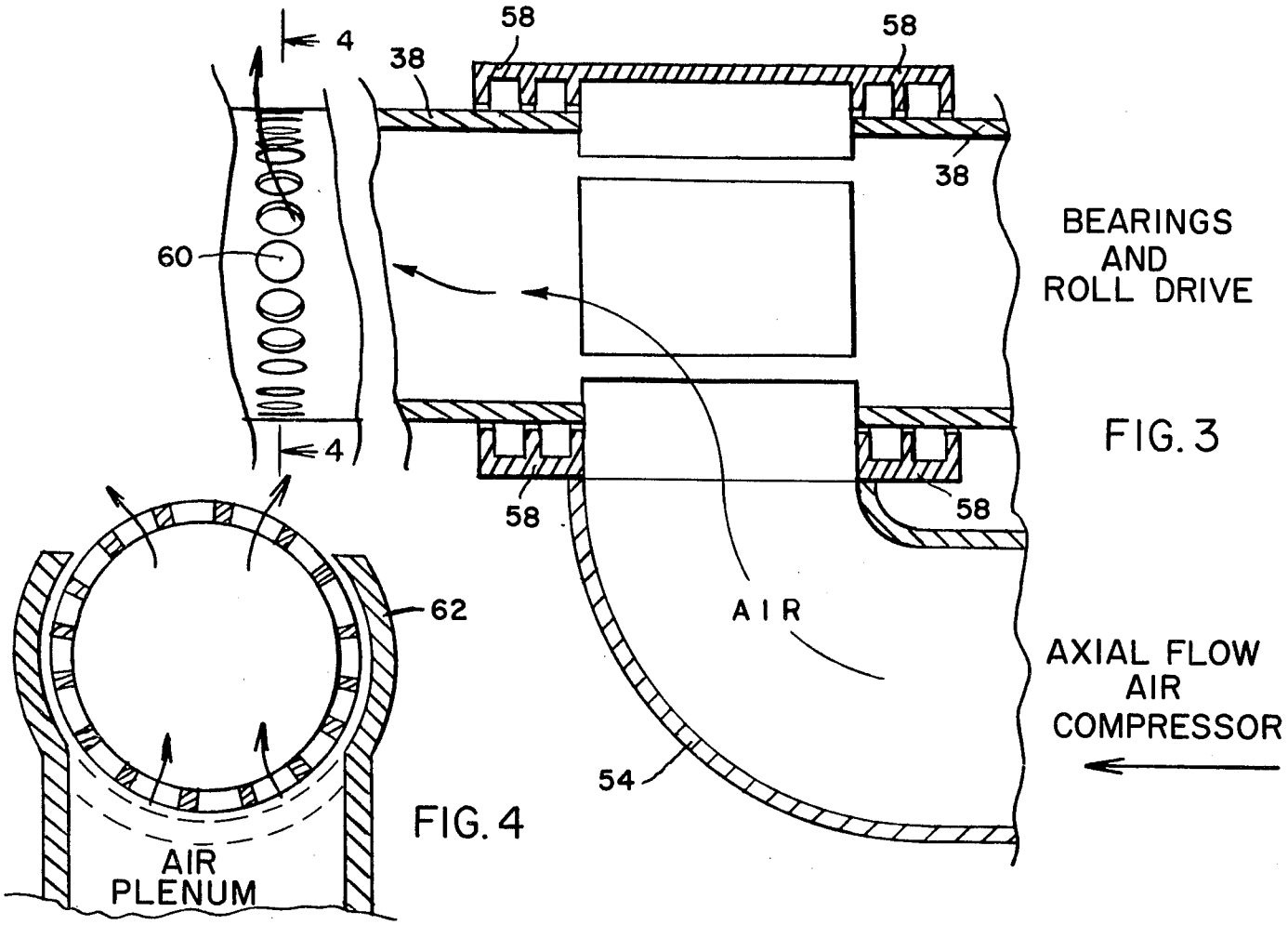
FIG. 3 is a view in cross section of a mechanism for applying cooling air axially to and internally of a perforated roller.
FIG. 4 is a view in cross section along the lines 4—4 of FIG. 3, but showing also a second means for applying cooling air to the rod through a perforated cooling roller.

Alternate means for applying the cooling air to the rod are shown in FIGS. 3 to 6. In FIG. 3 means are shown for admitting air under pressure to the interior of rollers 38 through ducts 54 and slots 56 at one end of each roller 38. Ducts 54 are stationary and the escape of air is prevented by gland seals 58. In this embodiment, rollers 38 are perforated at 60 in the areas where the rings 18 come in contact with rollers 38. Air passing through perforations impinges against the rod rings 18. The air may be concentrated against the rod by a cylindical shield 62 which prevents the escape of air except upwardly (see shield 62 of FIG. 4 with enclosed bottom along dotted lines). Axial flow, or turbine type, air compressors may be used to increase the air pressure and also individually to control each air application station.

A further alternative is shown in FIG. 4 in which air from plenums 40 is channelled through rollers 38 passing into perforations 60 at the bottom of each roller and outwardly at the top. This embodiment has the advantage of using the cooling air to cool the rollers 38. It also can be sectioned so as to confine the air application longitudinally of the rollers 38 so as to make sure that air destined for the dense part of the lay is not deflected laterally.

Figure 5:
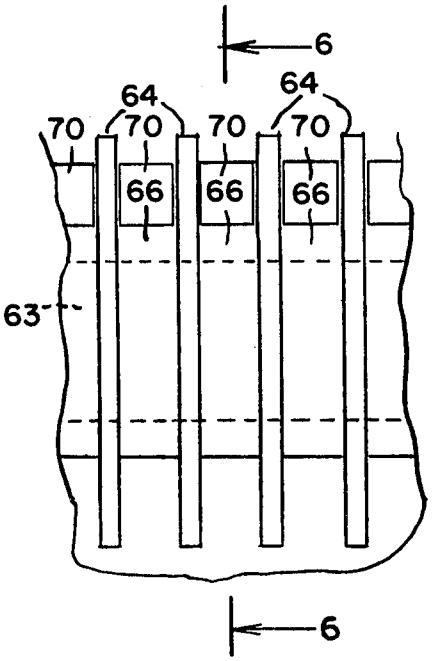
FIG. 5 is a view in end elevation (with respect to the work flow) of a slotted roller equipped for the application of cooling air to the rod.
Figure 6:
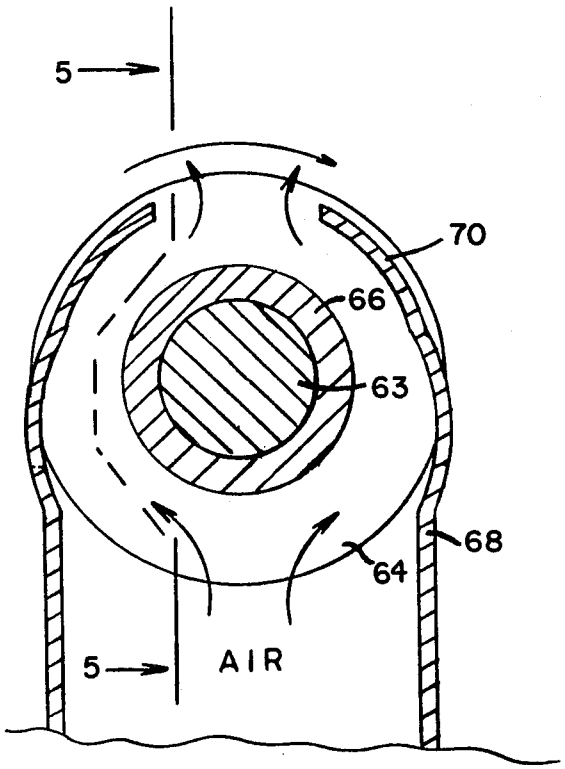
FIG. 6 is a view along the lines 6—6 of FIG. 5.

Still another embodiment, shown in FIGS. 5 and 6, employs a solid shaft 63 onto which are mounted disks 64 separated by spacers 66 at intervals along the shaft 63 with threaded headers at the shaft ends to hold them together. In this case, a shield 68 is employed which has fingers 70 extending upwardly between disks 64 at the top of the rollers positioned to channel the air and concentrate it against the rod. This embodiment has the advantages of providing a larger arc of roll contact in case a portion of rod rings 18 happens to sag down. It also has a very small area of contact (or exposure) between the hot rod and the roller surface which area of contact can be serrated for better traction. This, coupled with applying the cooling air both to the disks 64 and to the insides of shield elements 68 and 70, helps keep the rollers cool and makes the air cooling more efficient. This embodiment also permits the application of cooling air at different pressures and independently such that back-pressure at any given point does not cause a stoppage of air flow. Another advantage of this embodiment has to do with the materials out of which the rollers are made. In the embodiments of FIGS. 2 to 4, expensive, heat resistant, steels must be used for the rollers to accommodate the high heat of the retarded cooling and heat treatment modes of operation. In the embodiments of FIGS. 5 and 6, however, a rim of expensive metal on disks 64 is all that is needed, and shafts 63, spacers 66, and the remainder of disks 64 can be made of less expensive metal.

In addition a sleeve of insulating material surrounding shaft 63 can be employed. Also spacers 66 can be made of insulating material. Also the shaft 63 can be hollow and adapted for the circulation of cooling water through it. While rollers as shown in FIGS. 3 to 6 and described, bear a special cooperative relationship to the related and surrounding structures, they also present unique advantages in themselves, and therefore, we intend to claim them both alone and in combination.

The apparatus of the invention provides a wide range of treatment options within one and the same piece of equipment all on a single treating line and all at push-button control. For example, for an annealing type operation, the operator can operate the conveyor in an intermittent manner so as to form spaced, relatively large, stacked bundles with only a few connecting rings in between. In this way treatments such as subcritical, full, isothermal, and cycle annealing can be simulated, but with the advantage of avoiding the time and energy required in those processes to heat the rod. The time available for treatment depends upon rolling speed, the conveyor speed, the concentration of metal on the conveyor and the length of the conveyor. Thus, a 300′ conveyor moving a 5 fpm can subject the rod to treatment for one hour, which is adequate for many types of annealing when a reheating cycle is not involved. Of course, merely by removing the covers, speeding up the conveyor, turning off the heaters, and turning on the air cooling, an immediate (labor free) change to the rapid cooling modes of operation can be made.

Having thus described preferred embodiments of our invention, various modifications will now be apparent to those skilled in the art and therefore, it is not our intention to confine the invention to the precise form herein shown but rather to limit in terms only of the appended claims.

We claim:

1. Apparatus for rolling and treating steel rod comprising:

(a) a rod rolling mill, (b) delivery means for receiving said rod from (a), (c) a laying head for receiving said rod from (b), and forming said rod into a succession of relatively stationary rings, (d) a conveyor for receiving said rings from (c), (e) means for driving (d) whereby said rings become spread out on (d), (f) a portion of (d) comprising spaced rollers, (g) means for applying head to said rod generally from above and a heating element between each pair of rollers to heat said rod from below, and (h) air cooling means associate with each said roller in (f) for applying a jet of cooling air directly upwardly to the under surface of each said roller, whereby said cooling air flows around said rollers and impinges against the under surfaces of said rings.

2. The apparatus defined in claim 1 further characterized by:

(i) means for separately controlling each heating element in (g).

3. The apparatus defined in claim 1 further characterized by:

(j) means for individually controlling each cooling means (h).

4. The apparatus defined in claim 1 further charaterized by:

(k) means for guiding the cooling air from said orifice around each said roller.

5. The apparatus defined in claim 1 further characterized by:

(l) means associated with (b) for water-cooling said rod before it reaches (c).

6. The apparatus defined in claim 5 further characterized by:

(m) separate means for remotely controlling each of elements (d), (e), (f), (g), (h) and (l).

7. The apparatus defined in claim 1 further characterized by:

(n) means associated with (h) for applying said cooling air at different pressures along the axis of each of said rollers.

* * * * *